US008215408B2

(12) United States Patent
Yapici

(10) Patent No.: US 8,215,408 B2
(45) Date of Patent: Jul. 10, 2012

(54) ACTUATION SYSTEM FOR WELL TOOLS

(75) Inventor: Guney Guven Yapici, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 316 days.

(21) Appl. No.: 12/613,283

(22) Filed: Nov. 5, 2009

(65) Prior Publication Data

US 2011/0100645 A1 May 5, 2011

(51) Int. Cl.
*E21B 34/10* (2006.01)

(52) U.S. Cl. ... 166/375; 166/373; 166/386; 137/625.66; 251/50

(58) Field of Classification Search ..... 137/625.66; 166/319, 321, 373, 374, 375, 386; 251/50
See application file for complete search history.

(56) References Cited

U.S. PATENT DOCUMENTS 4,024,798 A * 5/1977 Schexnayder et al. ..... 91/436
5,497,804 A * 3/1996 Codina et al. ..... 137/554
6,491,102 B2 * 12/2002 Leismer et al. ..... 166/316
6,536,530 B2 * 3/2003 Schultz et al. ..... 166/375
7,331,398 B2 2/2008 Dwivedi et al.
2006/0254763 A1 * 11/2006 Tips et al. ..... 166/65.1
2006/0278399 A1 12/2006 Dwivedi
2007/0079968 A1 * 4/2007 Schultz et al. ..... 166/321
2009/0065218 A1 3/2009 Loretz et al.
2009/0243875 A1 10/2009 Mandrou et al.

OTHER PUBLICATIONS

International Application No. PCT/US2010/047992 International Search Report (Attached).*

* cited by examiner

*Primary Examiner* — William P Neuder
*Assistant Examiner* — Richard Alker
(74) *Attorney, Agent, or Firm* — Brandon S. Clark; Robert Van Someren

(57) ABSTRACT

A technique facilitates control over one or more well tools coupled to one or more corresponding control modules. Actuation of the control modules and the well tools may be achieved with three control lines connected to the one or more control modules. Transitioning of the control modules to sequential stages and the consequent actuation of the corresponding well tools is achieved by applying a single pressure level selectively through the three control lines.

12 Claims, 5 Drawing Sheets

ACTUATION SYSTEM FOR WELL TOOLS

BACKGROUND

The following descriptions and examples are not admitted to be prior art by virtue of their inclusion in this section.

In many well applications, valves are positioned downhole in the well to control the flow of various fluids, such as production fluids or injection fluids. The flow control valves are actuated by pressurized hydraulic fluid delivered downhole through control lines. A given well application may require multiple flow control valves with a plurality of control lines coupled to each valve to control actuation of the valve between states. However, space constraints in the wellbore can restrict the number of control lines that are routed downhole.

Multidrop systems have been developed in which the number of control lines is less than the number of flow control valves. In one example, a device is used which allows the selection of a specific downhole well tool via the use of different pressure levels. Hydraulic control signals are furnished at relatively low pressures to actuate a selected well tool, and the hydraulic pressure is selectively increased over a threshold level to provide hydraulic power to the well tool. The hydraulic control actuation signals may be controlled by selectively pressurizing different hydraulic lines in a selected sequence and by selectively controlling the fluid pressure within a specific hydraulic line. The combination of selective sequential actuation and selective fluid pressure provides multiple actuation combinations for selectively actuating downhole well tools. However, the use of two or more pressure levels can restrict operation of the system in subsea wells and also can limit the potential number of downhole tools utilized in a single downhole string.

SUMMARY

In general, the present invention comprises a system and methodology in which one or more well tools may be coupled to one or more corresponding control modules. Actuation of the control modules and the well tools is achieved with three control lines connected to the one or more control modules. Transitioning of the control modules to sequential stages and the consequent actuation of the corresponding well tools is achieved by applying a single pressure level selectively through the three control lines.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for actuation of tools, such as well tools located downhole in a wellbore. A control module system having one or more control modules is used to selectively direct surface pressure to downhole well tools for individual actuation. The entire control module system may be controlled with three hydraulic lines that operate with a single pressure level. Each control module is engaged with the three control lines which are connected for achieving specific functions. For example, a first control line of the three control lines may comprise a pilot line which displaces a module piston for individual downhole well tool selection. Once the specific downhole well tool is selected, the second control line may be used to supply pressure to the specific well tool by routing actuation fluid past the module piston. A third control line may be used to reset the module piston to its original position after actuation of the specific downhole well tool is completed.

According to one example, each downhole well tool is coupled to a corresponding control module having a plurality of module piston actuation positions. The three control lines are coupled to the control module and the control module is transitioned through desired control module actuation positions by applying a single pressure level through the various control lines. Transitioning of the control module involves incrementally moving the module piston to a plurality of incremental positions that correspond with a plurality of no-actuation states and actuation states of the downhole well tool. When the control module is in a desired incremental position, actuation fluid from the second control line may be flowed through the control module to the downhole well tool for actuation to a desired state, e.g. an open state or a closed state for example. A metering piston may be used to control movement of the module piston to each incremental position that corresponds with the no-actuation and actuation states of the downhole well tool.

Figure 1:
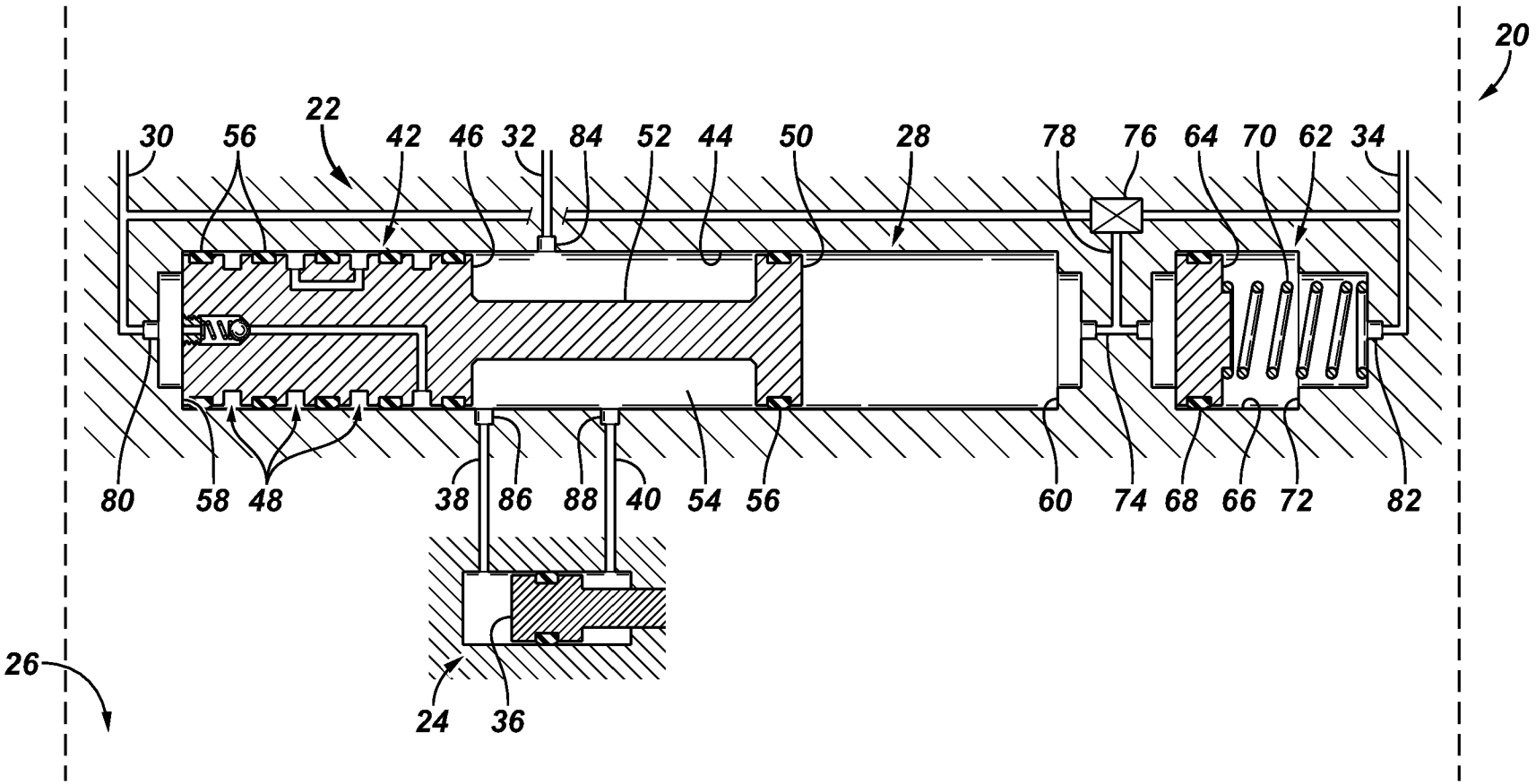
FIG. 1 is a schematic view of one example of a well control system having a control module coupled to a well tool, according to an embodiment of the present invention.

Referring generally to FIG. 1, one example of a well system 20 is illustrated as having a control module system 22 and a downhole well tool 24 disposed in a wellbore 26. To facilitate explanation of the well system, the control module system 22 is illustrated as having a single control module 28 coupled to the single corresponding downhole well tool 24. However, the control module system 22 may comprise a plurality of control modules 28 coupled to a plurality of corresponding downhole well tools 24. Regardless of whether the control module system 22 comprises an individual control module or a plurality of control modules, the control module system 22 comprises three control lines, e.g. first control line 30, second control line 32, and third control line 34. The three control lines 30, 32, 34 control operation of the control modules 28 and corresponding downhole well tools 24 through application of a single pressure level. By way of example, the three control lines comprise hydraulic control lines.

In the embodiment illustrated in FIG. 1, the downhole well tool 24 comprises an actuator 36 that may be selectively moved in opposite directions. For example, the actuator 36 may be moved to transition the downhole well tool 24 between an open state and a closed state. In some applications, downhole well tool 24 is a flow control valve selectively actuatable or multi-positionable between and including a fully opened flow state and a fully closed flow state (e.g., comprising several incrementally opened positions, among others). As illustrated, the downhole well tool 24 is operatively coupled with the corresponding control module 28 via a pair of hydraulic lines 38, 40 such that flow of actuation fluid through hydraulic line 38 transitions the downhole well tool 24 to a first state, such as an open state, while flow of actuation fluid through hydraulic line 40 transitions the downhole well tool 24 to a second state, such as a closed state.

Accordingly, control module 28 is coupled to a first and second side (e.g., such as an open and closed side) of the downhole well tool 24. In this embodiment, control module 28 comprises a module piston 42 translatable (e.g., slidable) in a module piston housing 44. The module piston 42 comprises a primary piston portion 46 having a plurality of piston channels 48, e.g. annular piston channels. Additionally, the module piston 42 comprises a secondary piston portion 50 coupled with primary piston portion 46, for example, by a solid link 52, which is surrounded by a space 54 such as an annular space. Primary piston portion 46 and secondary piston portion 50 may be sealed with respect to the inner surface of the surrounding module piston housing 44 via a plurality of seals 56, such as ring seals. The seals 56 located in primary piston portion 46 also serve to isolate piston channels 48 from each other along module piston housing 44.

The ultimate movement of module piston 42 within module piston housing 44 is respectively limited in either direction by hard stops 58 and 60. Additionally, movement of module piston 42 between hard stops 58, 60 is controlled and limited to specific increments by a metering piston assembly 62. By way of example, metering piston assembly 62 comprises a metering piston 64 translatable (e.g., slidable) in a surrounding metering piston housing 66 and sealed with respect to the metering piston housing 66 via a seal 68. As illustrated, metering piston 64 is biased toward one end of metering piston housing 66 via a resilient member 70 (shown in this illustrative embodiment as a coil spring), and its movement against resilient member 70 is limited by a hard stop 72.

The module piston housing 44 and metering piston housing 66 are connected via a flow channel 74. In the embodiment illustrated, flow channel 74 also is coupled with a pilot valve 76 via a flow channel 78. Additionally, control line 30 is coupled with the pilot valve 76 and also coupled with the module piston housing 44 via a hydraulic port 80. Hydraulic port 80 is located through module piston housing 44 on a side of primary piston portion 46 opposite to the secondary piston portion 50 (i.e., also functionally opposite to flow channel 74). Control line 34 is coupled with the pilot valve 76 and also coupled with the metering piston housing 66 via a hydraulic port 82. Hydraulic port 82 is located through metering piston housing 66 on a side of metering piston 64 functionally opposite to the flow channel 74. Control line 32 is coupled with module piston housing 44 via a port 84. The port 84 is located generally through the side wall of module piston housing 44 in a location which enables selective communication of actuation fluid with space 54 and piston channels 48.

The first control line 30 is used to supply pressure at a given pressure level to actuate, e.g. move, module piston 42. Control line 32 is the control line which also supplies pressurized fluid at the same given pressure level to selectively enable actuation of downhole well tool 24. Control line 34 is used to reset module piston 42 to its original position after being actuated by supplying pressurized fluid at the same given pressure level. Accordingly, all control lines operate at the same pressure level and enable selective actuation of the control module(s) and well tool(s) using a single pressure level.

In the initial position of module piston 42, as illustrated in FIG. 1, control line 32 communicates with both sides of downhole well tool 24 via hydraulic ports 86, 88 which respectively direct flow into hydraulic lines 38, 40. Consequently, pressure in control line 32 is balanced across the actuator 36 and does not result in actuation of the downhole well tool 24, leaving the well tool in a no-actuation state. To actuate the downhole well tool 24, the module piston 42 is moved in a manner that enables communication of pressure from control line 32 to only one side of the actuator 36 in downhole well tool 24. The fluid on an opposite side of actuator 36 is simultaneously exhausted as the actuator 36 is moved.

The desired actuation of downhole well tool 24 is achieved by incrementally displacing the module piston 42 to desired positions that enable specific fluid flows, e.g. opening flow, closing flow, no-flow. The incremental motion of the module piston 42 is achieved by metering the fluid from module piston housing 44 on a side of secondary piston portion 50 opposite to primary piston portion 46. The fluid is metered from piston module housing 44 via flow of fluid from module piston housing 44 into metering piston housing 66 via flow channel 74. However, movement of module piston 42 is limited by the volume of fluid able to flow into metering piston housing 66 before metering piston 64 is prevented from further movement via hard stop 72.

The metering function is achieved by connecting first control line 30 with pilot valve 76 which is designed to normally be in an open flow position. The pilot valve 76 is located between the module piston 42 and the metering piston 64. When pressure is applied in the first control line 30 at the single given pressure, this pressure transitions the normally open pilot valve 76 to a closed position. As soon as the pilot valve 76 closes and the spring and seal friction forces of metering piston assembly 62 are exceeded, the module piston 42 begins moving along module piston housing 44. This movement forces fluid into metering piston housing 66. Movement of module piston 42 and metering piston 64 continues until the metering piston 64 engages hard stop 72.

When the pressure in control line 30 is released, pilot valve 76 returns to its normally open position and the metering piston 64 is forced back to its original position by resilient member 70 (shown in this illustrative embodiment as a coil spring). As metering piston 64 is moved to its original position, fluid is exhausted from metering piston housing 66 through flow channels 74, 78, through pilot valve 76, and into control line 34. At this stage, the module piston 42 has been moved through one incremental displacement of a sequence of incremental movements, as explained in greater detail below. After the incremental advance, the module piston 42 remains at its new position.

Figure 2:
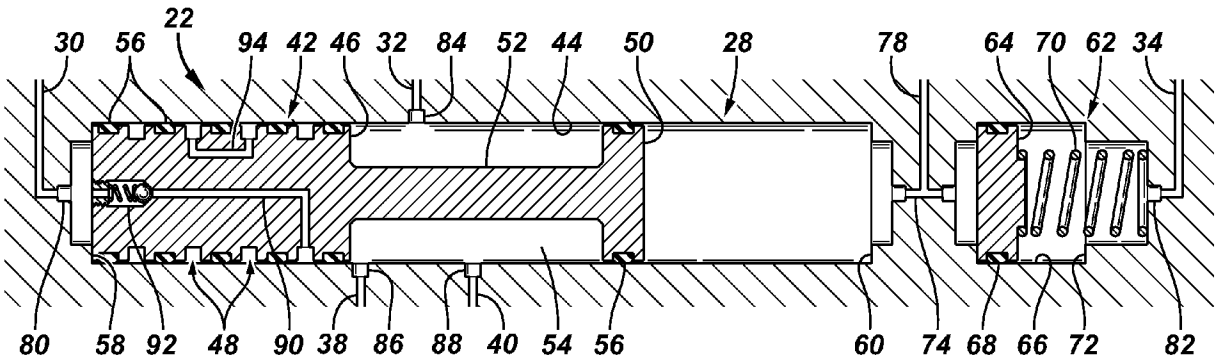
FIG. 2 is a schematic illustration of the control module illustrated in FIG. 1 in an initial or original position, according to an embodiment of the present invention.
Figure 3:
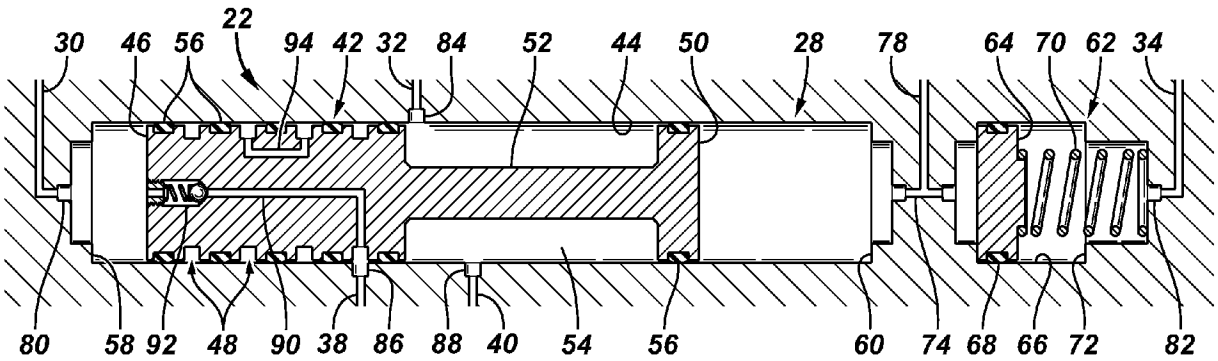
FIG. 3 is a schematic illustration similar to that of FIG. 2 but with the control module illustrated in a next incremental position, according to an embodiment of the present invention.

In FIG. 2, the control module 28 is illustrated with module piston 42 at its initial actuation position prior to supplying the pressurized fluid at the single pressure level in control line 30. In this position, the primary piston portion 46 is at hard stop 58 and the single pressure level may be applied in control line 30 and through hydraulic port 80 to initiate the control module sequence. As described above, the module piston 42 is displaced through a first increment controlled by metering piston assembly 62. In the illustrated example, the module piston 42 initially is moved one incremental position to the right, as illustrated in FIG. 3.

After moving through the first increment, control line 32 via hydraulic port 84 is placed in communication with hydraulic port 88 and hydraulic line 40. When the single pressure level is applied in control line 32, downhole well tool 24 is transitioned to another actuation state via movement of actuator 36 (see FIG. 1). In one example, the well tool 24 is transitioned to a closed state. Fluid on an opposite side of actuator 36 is exhausted through an interior channel 90 routed through primary piston portion 46 of module piston 42. The exhausted fluid flows through a check valve 92 which may be located at a left end of primary piston portion 46, as illustrated in FIG. 3. It should be noted that check valve 92 is unidirectional and acts as a barrier against pressure actuations from control line 30. After the exhausted fluid is passed through check valve 92, it enters module piston housing 44 on the left side of module piston 42, which displaces fluid outwardly through hydraulic port 80.

The control module 28 may be transitioned to another control module actuation position by causing another incremental movement of module piston 42. A second actuation is achieved by again applying the single pressure level on control line 30 which closes pilot valve 76 (see FIG. 1) and incrementally displaces the module piston 42 to the position illustrated in FIG. 4. Again, metering piston assembly 62 controls the incremental amount of movement of module piston 42 and limits its movement to the actuation position illustrated in FIG. 4.

Figure 4:
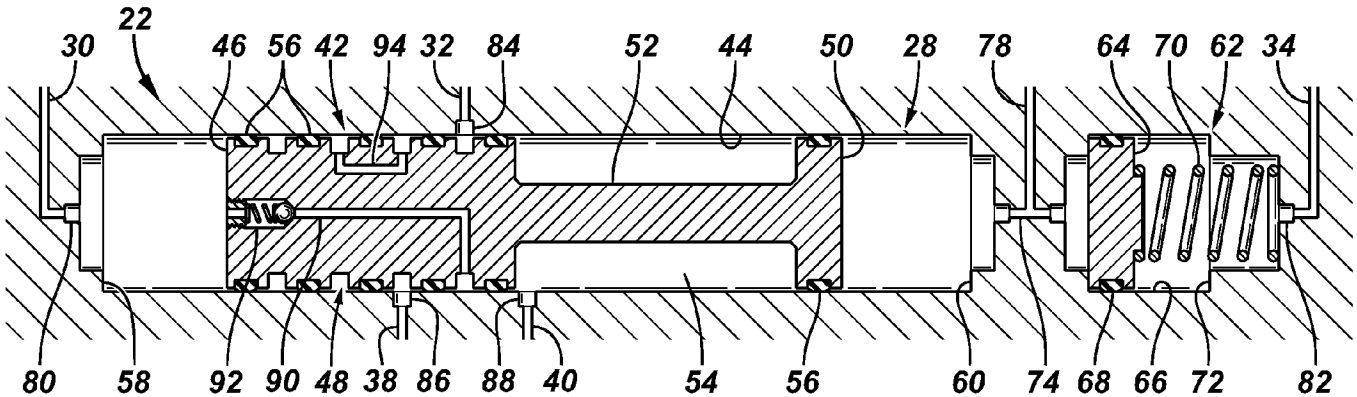
FIG. 4 is a schematic illustration similar to that of FIG. 3 but with the control module illustrated in a next incremental position, according to an embodiment of the present invention.

When the module piston 42 is positioned as illustrated in FIG. 4, fluid/pressure delivered through control line 32 is unable to reach downhole well tool 24. Any fluid delivered via control line 32 is directed into the piston channel 48, routed through interior channel 90 and check valve 92, and flowed into the module piston housing 44 to the left of module piston 42 to displace fluid through hydraulic port 80. Accordingly, pressure applied to control line 32 when control module 28 is in this actuation position simply causes fluid from control line 32 to be exhausted into control line 30.

Subsequently, the control module 28 may again be incrementally transitioned to another control module actuation position. A third actuation is achieved by similarly applying the single pressure level on control line 30 which closes pilot valve 76 (see FIG. 1) and incrementally displaces the module piston 42 to the next incremental actuation position illustrated in FIG. 5. Again, metering piston assembly 62 controls the incremental amount of movement of module piston 42 and limits its movement to the actuation position as illustrated in FIG. 5.

Figure 5:
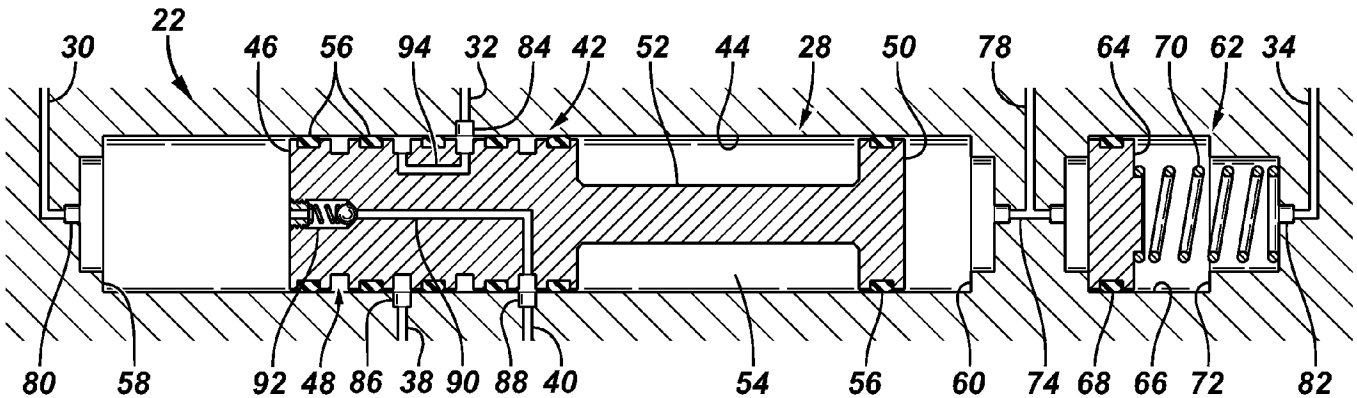
FIG. 5 is a schematic illustration similar to that of FIG. 4 but with the control module illustrated in a next incremental position, according to an embodiment of the present invention.

When the module piston 42 is positioned as illustrated in FIG. 5, fluid/pressure is delivered through control line 32 to transition downhole well tool 24 to another actuation state. While control module 28 is in the position illustrated in FIG. 5, fluid can be flowed from control line 32 across module piston 42 and out through hydraulic port 86 into hydraulic line 38. The fluid, pressurized at the single pressure level, flows into downhole well tool 24 and moves actuator 36 to another state (see FIG. 1). In this specific example, the actuator 36 is moved to transition downhole well tool 24 to an open state. During transition of actuator 36 fluid from control line 32 flows into one piston channel 48 and is transferred to another piston channel 48 via an interior channel 94. The latter piston channel 48 routes the fluid to hydraulic port 86 to enable the desired actuation of downhole well tool 24. Fluid on an opposite side of actuator 36 (the right side of actuator 36) is exhausted through the control line 40, interior channel 90 and check valve 92. The fluid passing through check valve 92 enters module piston housing 44 and displaces fluid outwardly through hydraulic port 80, into control line 30.

Figure 6:
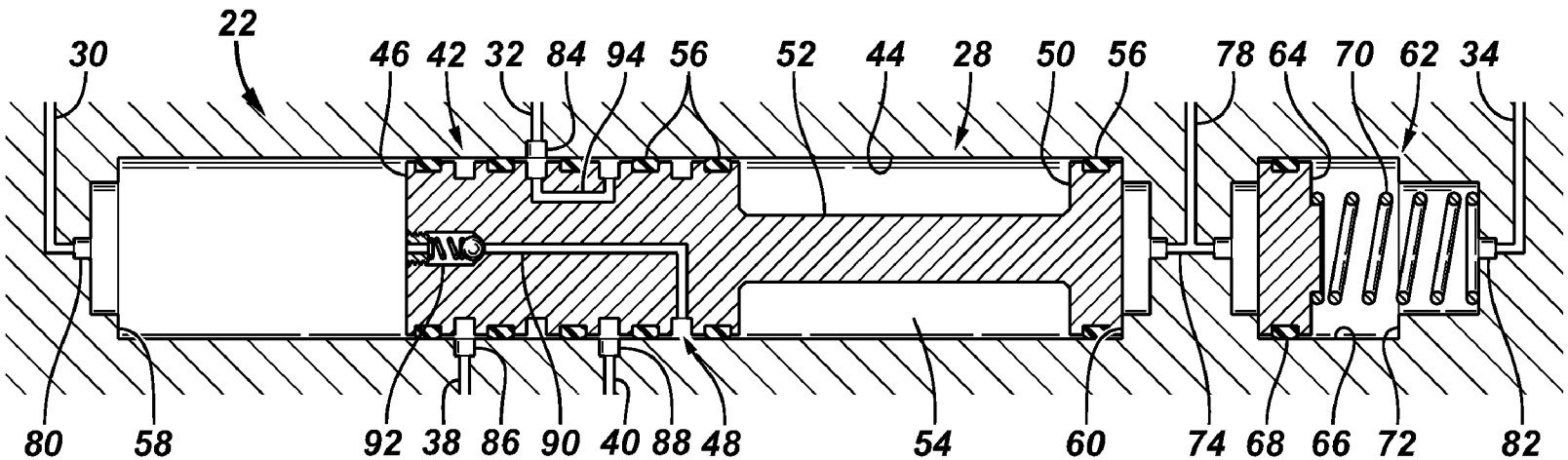
FIG. 6 is a schematic illustration similar to that of FIG. 5 but with the control module illustrated in a next incremental position, according to an embodiment of the present invention.

As illustrated in FIG. 6, the control module 28 may again be incrementally transitioned to another control module actuation position. Each subsequent actuation is achieved by similarly applying the single pressure level on control line 30 which closes pilot valve 76 (see FIG. 1) and incrementally displaces the module piston 42 to the next incremental actuation position. During incremental advancement of module piston 42, metering piston assembly 62 controls the incremental amount of module piston 42 movement.

In this particular example, the incremental position illustrated in FIG. 6 is the final control module actuation position in which module piston 42 is blocked from further movement via hard stop 60. At the final incremental position, control line 32 is placed into communication with downhole well tool 24 on the first, e.g. closing, side of actuator 36 via interior channel 94 and hydraulic port 88. However, pressure applied on control line 32 does not result in movement of actuator 36 or actuation of downhole well tool 24 (see FIG. 1). The no-actuation state results because fluid in downhole well tool 24 is blocked from exhausting by primary piston portion 46 of module piston 42. Accordingly, the illustrated embodiment of control module 28 provides a final control module actuation position that is a no-actuation position with respect to downhole well tool 24.

At any time during the above sequence of incremental module piston 42 advances, the position of the module piston 42 can be reset by pressurizing control line 34. Pressure in control line 34 communicates with both sides of metering piston 64 via port 82 and the normally open pilot valve 76 (see FIG. 1). Accordingly, when control line 34 is pressurized at the single pressure level, the module piston 42 moves back to its initial position adjacent hard stop 58 while metering piston 64 remains at its original position.

The basic functions of a single control module 28 have been described above, however a plurality of control modules 28 may be attached to a plurality of corresponding tools, e.g. downhole well tools 24, and share the same three control lines 30, 32 and 34. When the control module system 22 comprises a plurality of control modules 28, each pressure actuation on any of the control lines 30, 32 or 34, is applied at every control module. However, the control modules 28 may be designed to enable individual control over given downhole tools 24. By way of example, each control module 28 may utilize a unique module piston housing 44 having its hydraulic ports 84, 86, 88 positioned at unique locations relative to the hydraulic ports of other control modules. The design and arrangement of multiple control modules 28, e.g. more than three control modules, in control module system 22 enables selective control of individual well tools 24 along a downhole tool string with the use of only three control lines via application of only a single pressure level.

Figure 7:
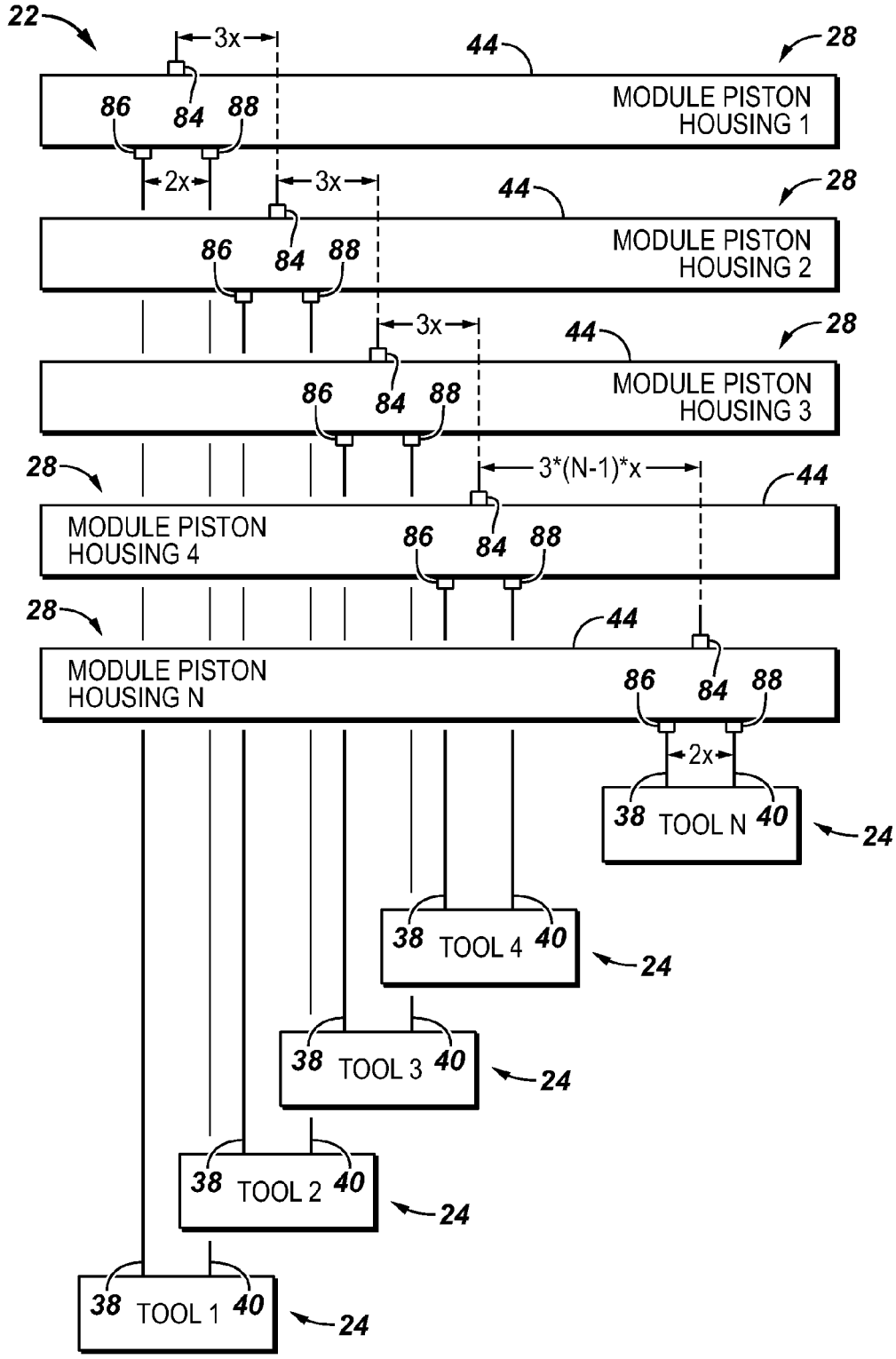
FIG. 7 is a schematic illustration of a plurality of control modules that may be coupled to a corresponding plurality of well tools in a manner that enables individual control over the well tools, according to an embodiment of the present invention.

Referring generally to the schematic embodiment illustrated in FIG. 7, a plurality of control modules 28 is coupled with a plurality of corresponding tools 24. Each control module 28 has a control module housing 44 with hydraulic ports uniquely located relative to the hydraulic ports of the other control modules. For example, the second control module 28 (second from the top control module 28) has its module piston housing 44 designed with ports 84, 86, 88 which are sufficiently far away from the hydraulic ports positioned in the first control module 28 such that pressurizations used to actuate the first downhole tool 24 do not affect the second downhole tool.

The lack of effect on the second downhole tool 24 is achieved by maintaining the no-actuation state of the second tool while the first tool is actuated. The second tool 24 remains in the no-actuation state until the first tool reaches its final position no-actuation state when the module piston 42 of the first control module 28 is against hard stop 60, as described above. Successive tools 24 in the downhole string utilize a similar concept such that their module piston housings 44 have hydraulic port arrangements which enable a no-actuation state while a given tool 24, e.g. a previous tool, is actuated. Consequently, the control module housings 44 of control modules 1 through N may be used to enable individual control over the corresponding well tools 1 through N as illustrated in FIG. 7. The design described herein enables utilization of only three control lines and a single pressure level to control an infinite number of control modules 28 and corresponding tools 24, subject only to potential physical length restrictions with respect to the module piston housings.

Well system 20 may be constructed in a variety of configurations for use with many types of well systems in many types of environments. The wellbore may be drilled in a variety of formations and other subterranean environments. Furthermore, many types of tool strings may be deployed in the wellbore to carry out desired well applications, including production applications, well service applications, and other well related applications. The number and arrangement of control modules in a given control module system is adjusted according to the number of desired actuatable tools 24 utilized in a given well application. In some applications, individual actuatable tools 24 may be employed, while other applications may require multiple actuatable tools in which the number of tools is greater than the three control lines. Furthermore, the actuatable tools may comprise many types of downhole well tools and/or other tools, including a variety of valves and other types of tools that may be actuated among desired tool states.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for actuating a tool in a well, comprising:

a downhole well tool;

a pilot valve; and a control module coupled to the downhole well tool to control actuation of the downhole well tool, the control module comprising a module piston and three control lines in which a first control line delivers a fluid to displace the module piston to a desired downhole well tool actuation position, a second control line supplies fluid to the downhole well tool to actuate the downhole well tool, and a third control line supplies fluid to reset the module piston after a desired actuation of the downhole well tool, wherein the three control lines operate with a single pressure level, and wherein:

the module piston is moved through a module piston housing in predetermined increments;

the predetermined increments are controlled by a metering piston; and the pilot valve enables return of the metering piston to an original position between each incremental move of the module piston.

2. The system as recited in claim 1, wherein the downhole well tool comprises a flow control valve.

3. The system as recited in claim 1, wherein the downhole well tool comprises a plurality of downhole well tools that may be individually controlled.

4. The system as recited in claim 3, wherein the control module comprises a plurality of control modules each having a module piston housing with hydraulic actuation ports positioned at unique locations along the module piston housing relative to the positioning of actuation ports along the other module piston housings.

5. The system as recited in claim 1, wherein the module piston comprises a plurality of flow channels located to control flow of actuation fluid through the second control line in a desired manner at each incremental position as the module piston is moved through the predetermined increments.

6. The system as recited in claim 5, wherein the ultimate movement of the module piston in either direction along the module piston housing is controlled by hard stops.

7. A method of downhole actuation in a well, comprising:

coupling a downhole well tool to a control module having a plurality of control module actuation positions, wherein coupling comprises coupling a plurality of downhole tools to a plurality of control module housings having internal module pistons;

connecting three control lines to the control module;

transitioning the control module through the plurality of control module actuation positions, wherein transitioning comprises selectively moving the internal module pistons within the control module housings via the single pressure level, and transitioning further comprises moving a module piston to incremental positions in a module piston housing;

actuating the downhole well tool through a plurality of actuation states that correspond with the control module actuation positions;

applying only a single pressure level selectively through the three control lines to accomplish transitioning of the control module and actuating of the downhole well tool; and wherein:

each of the plurality of control module housings comprises a pilot valve that enables the return of the metering piston to an original position between each incremental position.

8. The method as recited in claim 7, further comprising controlling movement of the module piston through the incremental positions with a metering piston.

9. The method as recited in claim 8, wherein actuating comprises controlling a flow of actuation fluid to the downhole tool by aligning selected flow channels in the module piston with corresponding hydraulic ports in the module piston housing.

10. A system to control downhole actuation, comprising:

a control module, comprising:

a module piston mounted in a module piston housing, the module piston having a plurality of flow channels to direct an actuation fluid from an inlet port in the module piston housing to a selected outlet port or to a no-flow position;

a metering piston coupled in cooperation with the module piston to limit movement of the module piston to incremental movements within the module piston housing to selectively control flow of the actuation fluid; and a plurality of control lines in which a first control line delivers fluid to move the module piston through the module piston housing; a second control line delivers the actuation fluid; and a third control line supplies fluid to reset the module piston to an original position; and a pilot valve closed by pressurized fluid delivered via the first control line, the removal of pressure in the first control line allowing the pilot valve to open, wherein upon opening of the pilot valve fluid may be delivered through the third control line to move the module piston back to its original position.

11. The system as recited in claim 10, wherein the plurality of control lines delivers fluid limited to a single pressure level.

12. The system as recited in claim 10, further comprising a downhole well tool connected in fluid communication with the module piston housing to selectively receive the actuating fluid.

* * * * *